US006226831B1

(12) United States Patent
Berfield

(10) Patent No.: US 6,226,831 B1
(45) Date of Patent: May 8, 2001

(54) SELF-EVACUATING VACUUM CLEANER

(75) Inventor: Robert C. Berfield, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/589,493

(22) Filed: Jun. 7, 2000

Related U.S. Application Data

(63) Continuation of application No. 09/383,351, filed on Aug. 26, 1999.

(51) Int. Cl.[7] ..... A47L 7/00
(52) U.S. Cl. ..... 15/353; 15/352; 96/406
(58) Field of Search ..... 15/321, 352, 353; 96/406

(56) References Cited

U.S. PATENT DOCUMENTS

| | | | | |
|---|---|---|---|---|
| 2,336,716 | | 12/1943 | Clements . | |
| 3,220,638 | | 11/1965 | Petersen . | |
| 3,730,642 | | 5/1973 | Barnstead et al. . | |
| 4,080,104 | * | 3/1978 | Brown | 15/353 |
| 4,088,424 | | 5/1978 | Hyatt et al. . | |
| 4,172,710 | | 10/1979 | van der Molen . | |
| 4,226,575 | | 10/1980 | Hyatt et al. . | |
| 4,246,676 | * | 1/1981 | Hallsworth | 15/353 |
| 4,382,804 | | 5/1983 | Mellor . | |
| 4,526,507 | | 7/1985 | Bingler . | |
| 4,527,960 | | 7/1985 | DeSisto . | |
| 4,547,206 | | 10/1985 | Sovis et al. . | |
| 4,621,991 | | 11/1986 | Smith et al. . | |
| 4,640,697 | | 2/1987 | Erickson, Jr. . | |
| 4,655,681 | | 4/1987 | Mori et al. . | |
| 4,693,734 | | 9/1987 | Erickson, Jr. . | |
| 4,735,555 | | 4/1988 | Erickson, Jr. . | |
| 4,824,333 | | 4/1989 | Erickson, Jr. . | |
| 5,030,257 | | 7/1991 | Kasper et al. . | |
| 5,032,155 | | 7/1991 | Wiese et al. . | |
| 5,096,475 | | 3/1992 | Kasper et al. . | |
| 5,110,266 | | 5/1992 | Toyoshima et al. . | |
| 5,465,455 | * | 11/1995 | Allen | 15/353 |
| 5,555,597 | * | 9/1996 | Berfield | 15/353 |
| 5,573,369 | | 11/1996 | Du . | |
| 5,613,271 | * | 3/1997 | Thomas | 15/353 |
| 5,715,568 | * | 2/1998 | Berfield et al. | 15/353 |
| 5,752,997 | | 5/1998 | Roth . | |
| 5,850,668 | * | 12/1998 | Berfield et al. | 15/353 |
| 5,918,344 | * | 7/1999 | Crevling et al. | 15/353 |
| 5,966,775 | * | 10/1999 | Berfield | 15/353 |
| 6,009,596 | * | 1/2000 | Buss et al. | 15/353 |
| 6,049,940 | * | 4/2000 | Robitaille | 15/353 |
| B1 4,226,575 | | 3/1988 | Hyatt et al. . | |

FOREIGN PATENT DOCUMENTS

| | | |
|---|---|---|
| 1 389 222 | 4/1975 | (GB) . |

* cited by examiner

*Primary Examiner*—Terrence R. Till
(74) *Attorney, Agent, or Firm*—Marshall, O'Toole, Gerstein, Murray & Borun

(57) ABSTRACT

A pump has a housing defining a pump chamber and having a shaft opening. An impeller shaft extends through the shaft opening and is sized to define a gap between the impeller shaft and the shaft opening. An impeller is attached to the shaft inside the pump chamber. The impeller includes a first set of impeller blades for transporting fluid through the pump chamber and a second set of impeller blades for creating a pressure force which pushes fluid away from the shaft opening. The pump with sealless shaft prevents fluid from leaking through the gap, and therefore is particularly suited for use in a tank-type vacuum cleaner capable of collecting both dry material and fluid. The gap is used in such an application to prime the pump, thereby discharging fluid collected in the tank.

5 Claims, 10 Drawing Sheets

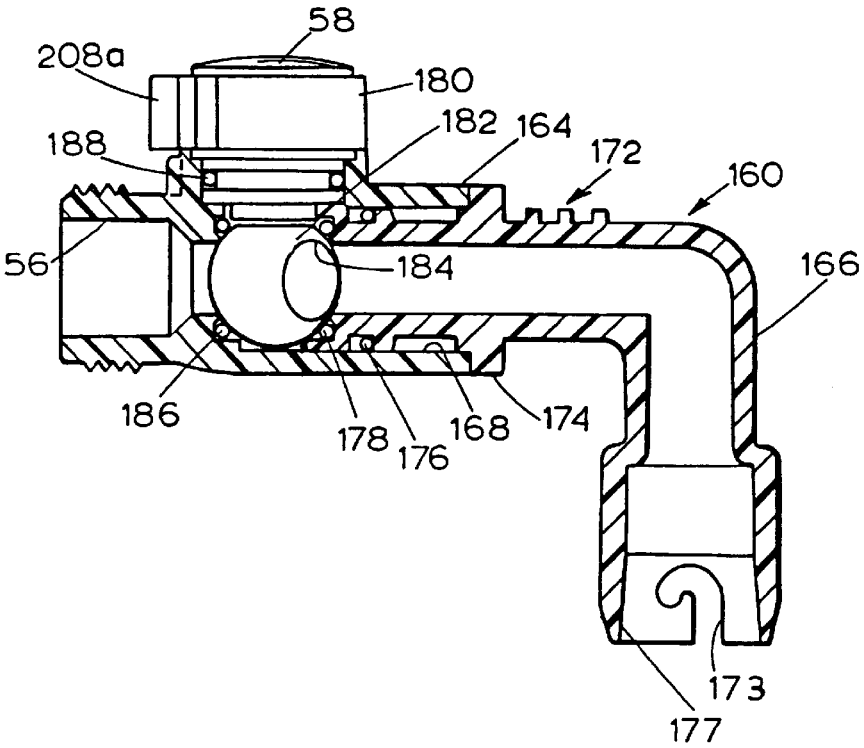
Fig. 7
Fig. 8
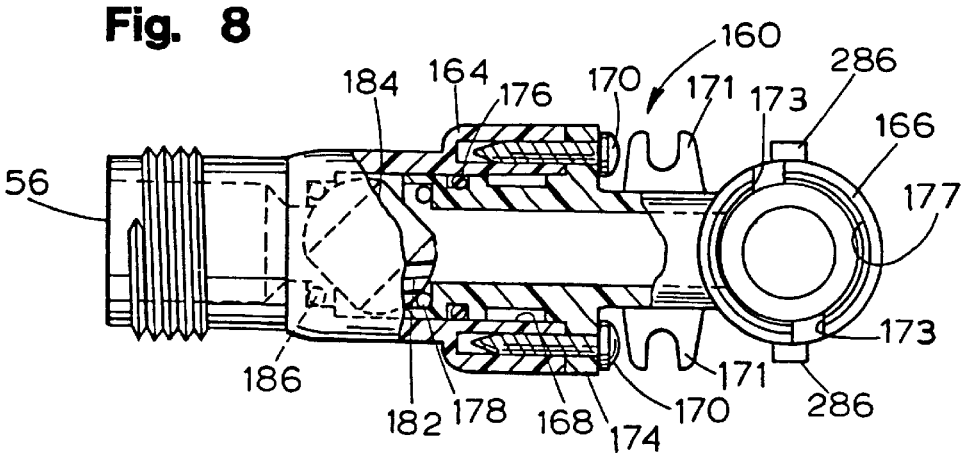
Fig. 9A
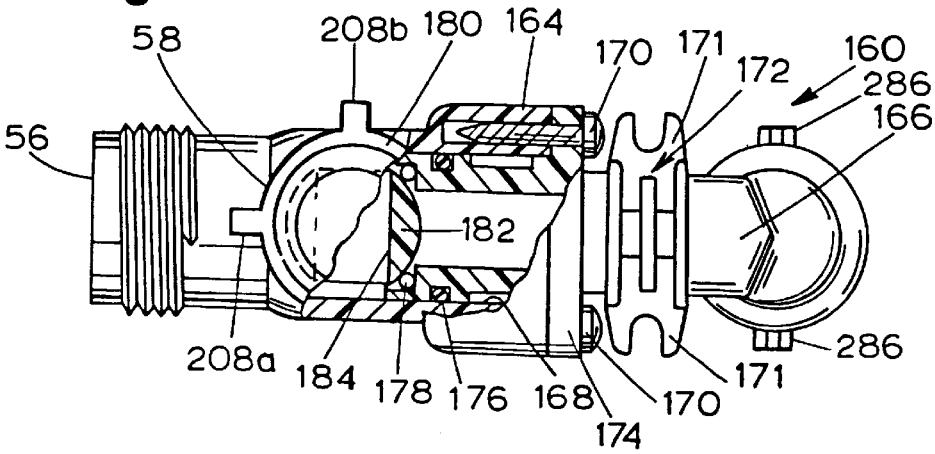

SELF-EVACUATING VACUUM CLEANER

This is a Continuation of U.S. application Ser. No. 09/383,351, filed Aug. 26, 1999.

FIELD OF THE INVENTION

The present invention relates to pumps, and more particularly to pumps having sealless shafts.

BACKGROUND ART

Pumps are used in a wide variety of applications to transport various types of materials. Centrifugal pumps, for example, are typically used to transport fluids. Such pumps are adapted for use with a motor having a rotating motor shaft, and generally include a housing defining a pump chamber, a fluid inlet, a discharge outlet, and a shaft opening. An impeller shaft is attached to the motor shaft, extends through the shaft opening in the pump housing, and has an end disposed inside the pump chamber. An impeller is attached to the impeller shaft so that, as the impeller rotates, fluid is drawn through the inlet and discharged through the outlet.

Such pumps typically include a seal at the shaft opening in the pump housing to prevent fluid from leaking along the impeller shaft. Such seals are typically provided in the form of a gasket, such as an o-ring, which is attached to the shaft opening and engages the impeller shaft. Conventional gasket seals, however, create a number of problems. Not only do the gasket seals themselves wear out, but the seals also cause wear on the impeller shafts. Such seals do not tolerate a shaft which rotates with a wobble or some other type of eccentricity, and the seals generate heat due to friction between the stationary seal and rotating impeller shaft. In addition, gasket seals rapidly wear out and fail when the pump is operated dry (i.e., when pump chamber is not filled with fluid). Furthermore, all gasket seals leak to some extent, regardless of seal material or tightness.

In one application, a centrifugal pump is incorporated into a vacuum cleaner. Tank-type vacuum cleaners have an air impeller disposed inside a tank which is capable of vacuuming dry materials such as debris or dirt and suctioning liquids into the tank. When the tank is full, the pump removes liquid from a lower portion of the tank and expels it through a hose to waste. As taught in commonly owned U.S. patent application Ser. No. 09/281,671 now U.S. Pat. No. 6,191,304, the air and pump impellers are advantageously connected to a common shaft which is rotating by a single motor. The air and pump impellers are mounted proximate one another in an upper portion of the tank, near the motor. As a result, it is important to prevent fluid from leaking through the shaft opening and into the air impeller and motor. It is also desirable, however, to use the vacuum produced by the air impeller to prime the pump.

In the above-referenced vacuum cleaner, a liquid deflector is positioned between the pump and air impeller to prevent fluid from reaching the air impeller and motor. In addition, the distance between the pump and the air impeller is increased, thereby lengthening the shaft. As a result, while these modifications adequately prevent fluid from reaching the air impeller and motor, the vacuum cleaner requires additional components, making assembly more difficult and expensive. Furthermore, the longer impeller shaft increases the likelihood of vibration and thus noise and additional wear on the shaft support bearings.

To utilize the vacuum produced by the air impeller to prime the pump, the impeller shaft is formed with a bore leading to an impeller backing plate formed with spacers, so that a path is formed from the air impeller, through the shaft, and to the pump chamber. A vacuum director is attached to the impeller shaft to further ensure that the vacuum is communicated to the shaft and ultimately to the pump chamber. Accordingly, the components used in the above vacuum cleaner are overly intricate and complex to assemble, and the weight supported by the rotating impeller shaft is overly excessive.

SUMMARY OF THE INVENTION

In accordance with one aspect of the present invention, a pump for transporting fluid is provided which is adapted for use with a motor having a rotating motor shaft. The pump comprises a pump housing having an inlet opening, an outlet opening, and a shaft opening, the pump housing defining a pump chamber. An impeller shaft has a first end adapted for connection to the motor shaft and a second end disposed inside the pump chamber, and the impeller shaft extends through the shaft opening in the pump and is sized to define a gap between the impeller shaft and the shaft opening. An impeller assembly is disposed inside the pump chamber and is attached to the second end of the impeller shaft. The impeller assembly includes a first set of impeller blades located near the inlet and outlet openings of the pump housing for drawing the fluid through the inlet opening and discharging the fluid through the outlet opening, and a second set of impeller blades located near the shaft opening of the pump housing for creating a pressure force which pushes fluid away from the shaft opening, thereby preventing fluid from leaking through the gap.

In accordance with another aspect of the present invention, a vacuum cleaner is provided which is adapted for attachment to a rotating motor shaft. The vacuum cleaner comprises a tank having an inlet for receiving liquid material and defining an interior. An impeller shaft is adapted for attachment to the rotating motor shaft, and a pump housing defines a pump interior and has an inlet opening, an outlet opening, and a shaft opening sized to receive the impeller shaft. A gap is defined between the shaft opening and the impeller shaft. A pump impeller is disposed inside the pump interior and is attached to the impeller shaft. The pump impeller includes a first set of impeller blades located near the inlet and outlet openings of the pump housing, and a second set of impeller blades located near the shaft opening of the pump housing. A pump inlet is disposed in the interior of the tank and is in fluid communication with the inlet opening of the pump housing, wherein the pump inlet places the interior of the pump in fluid communication with the interior of the tank. An air impeller assembly is disposed in air flow communication with the interior of the tank. The air impeller assembly includes a housing and a driven air impeller disposed in the housing, the housing defining an opening in air flow communication with the interior of the tank. The driven impeller creates a relatively low pressure area in the interior of the tank. A priming apparatus is in fluid communication with the pump interior, and means for establishing a pressure differential across liquid in the priming apparatus is provided thereby to prime the pump.

In accordance with yet another aspect of the present invention, a vacuum cleaner is provided which is adapted for attachment to a rotating motor shaft. The vacuum cleaner comprises a tank having an inlet for receiving liquid material and defining an interior. An impeller shaft is adapted for attachment to the rotating motor shaft, and a pump housing defines a pump interior and has an inlet opening, an outlet opening, and a shaft opening sized to receive the impeller shaft. A gap is defined between the shaft opening and the impeller shaft. A pump impeller is disposed inside the pump interior and is attached to the impeller shaft. The pump impeller includes a first set of impeller blades located near the inlet and outlet openings of the pump housing, and a second set of impeller blades located near the shaft opening of the pump housing. A pump inlet is disposed in the interior of the tank and is in fluid communication with the inlet opening of the pump housing. The pump inlet places the interior of the pump in fluid communication with the interior of the tank. An air impeller assembly is disposed in air flow communication with the interior of the tank and includes a housing and a driven air impeller disposed in the housing. The housing defines an opening in air flow communication with the interior of the tank and the air impeller defines an interior space. The driven air impeller creates a relatively low pressure area in the interior of the tank and in the interior space defined by the air impeller. A priming apparatus is disposed between the air impeller and the pump, wherein the priming apparatus places the interior of the pump in air flow communication with the low pressure area generated in the interior space defined by the air impeller and creates a low pressure area in the pump inlet. The pump is primed when the liquid material received by the tank is drawn through the pump inlet and into the pump interior.

Other features and advantages are inherent in the vacuum cleaner claimed and disclosed or will become apparent to those skilled in the art from the following detailed description in conjunction with the accompanying drawings.

BRIEF DESCRIPTION OF THE DRAWINGS

FIG. 7 is a partial view, partially in section, showing an upper portion of a liquid discharge assembly of the present invention;

FIG. 8 is a bottom view, partially broken away and partially in phantom of a ball valve of the liquid discharge assembly;

FIG. 9A is a partially broken away top view of the ball valve of the liquid discharge assembly in a closed (OFF) position;

DETAILED DESCRIPTION OF THE EMBODIMENT

Figure 3:
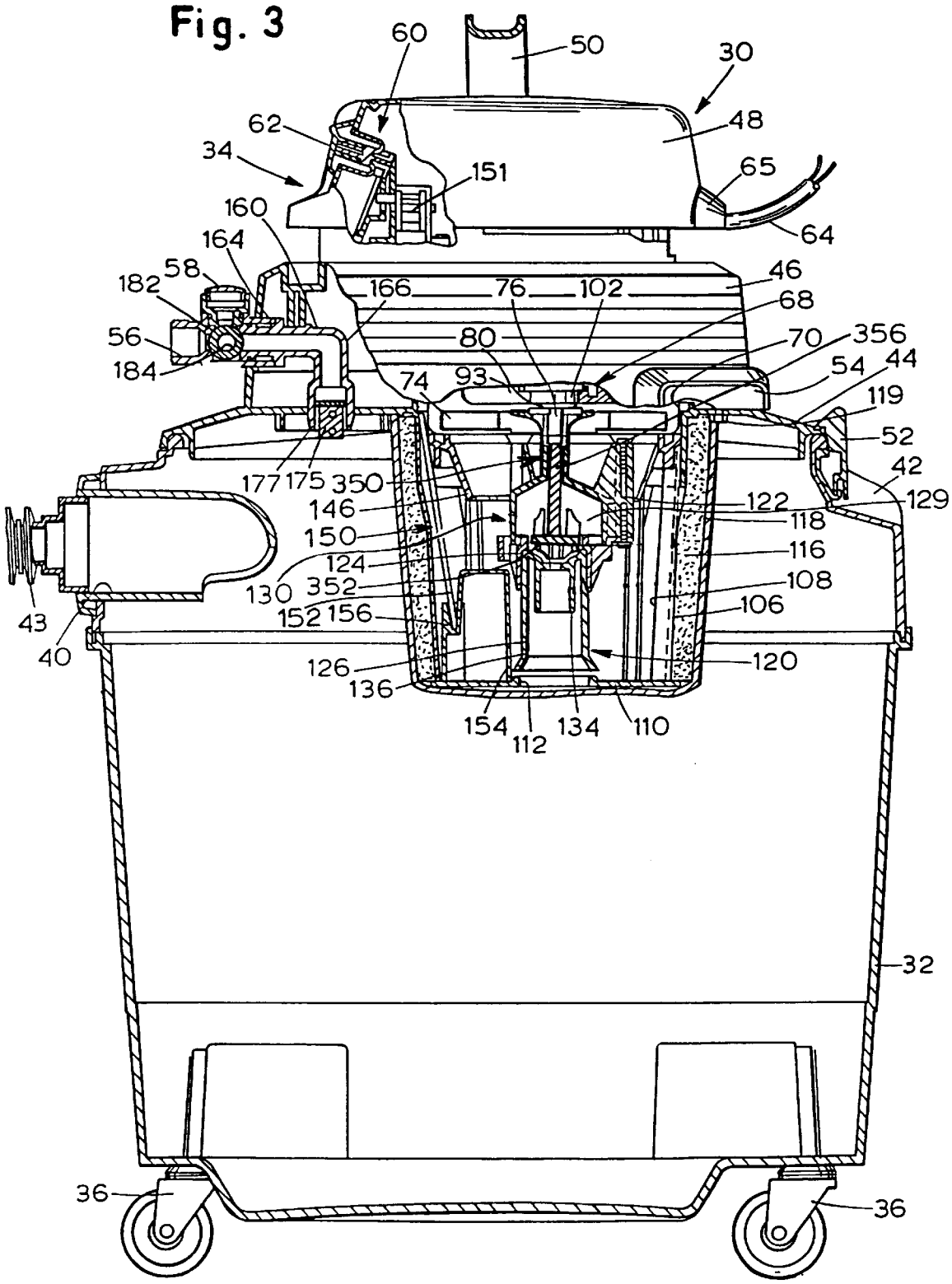
FIG. 3 is a side elevational view, partially in section along the line 3—3 in FIG. 2.

A pump 128 constructed in accordance with the present invention is shown in FIG. 3 in a preferred environment of use, namely, mounted inside a vacuum cleaner 30. While for clarity of illustration, the pump 128 is shown herein disposed in a specific type of vacuum cleaner 30, persons of ordinary skill in the art will readily appreciate that the teachings of the invention are in no way limited to use with that vacuum cleaner 30 or to any other particular environment of use. On the contrary, a pump constructed in accordance with teachings of the invention may be used in any type of material transport application which would benefit from the advantages it offers without departing from the scope or spirit of the invention.

Figure 1:
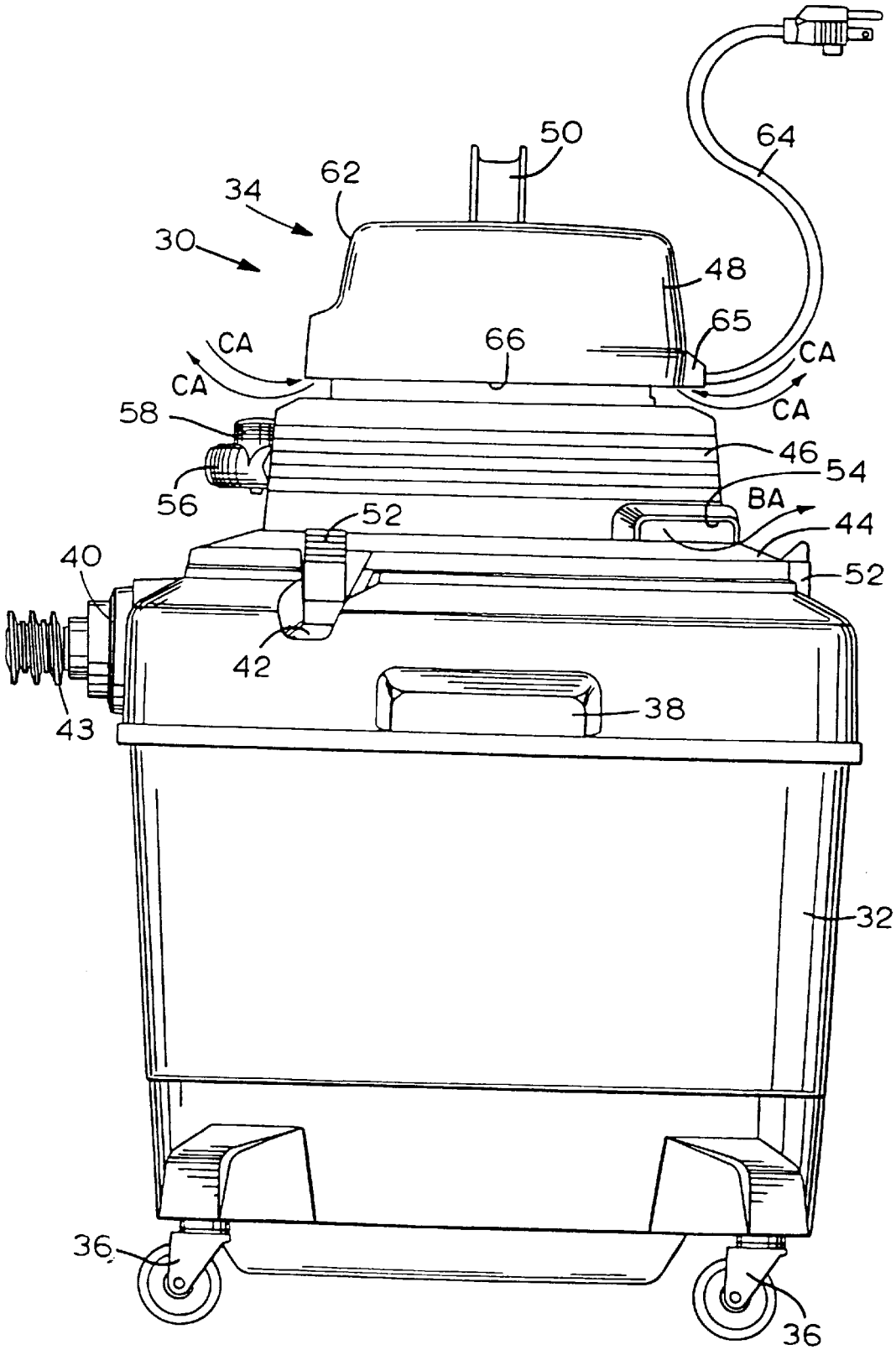
FIG. 1 is a side elevational view of a vacuum cleaner of the present invention.
Figure 2:
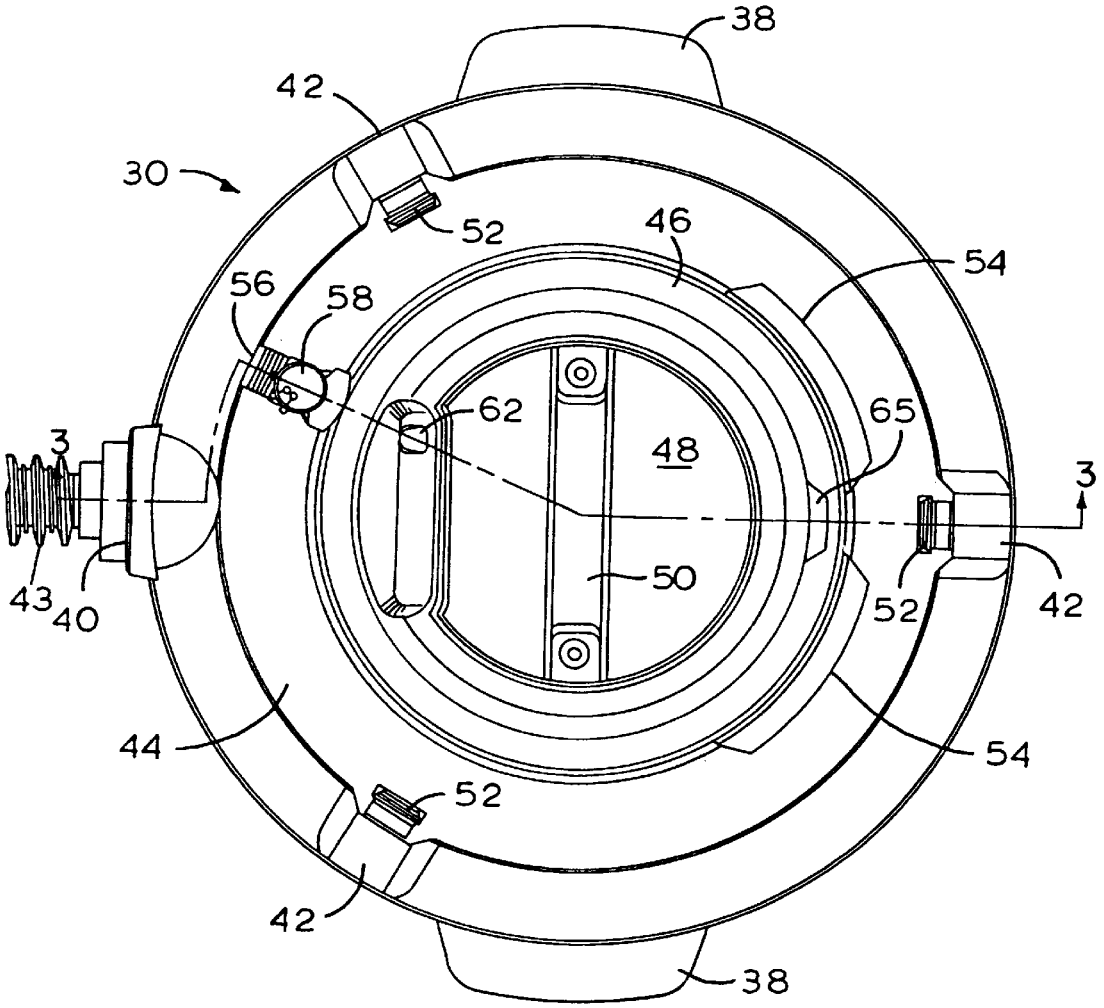
FIG. 2 is a top plan view of a vacuum cleaner of the present invention.

Referring initially to FIGS. 1 and 2, the vacuum cleaner 30 has a tank 32 and an upper vacuum assembly, indicated generally at 34. The tank 32 is supported by casters 36 and includes a pair of handles 38. The handles 38 may be used to assist the user in lifting and moving the vacuum cleaner 30. The tank 32 further defines a vacuum inlet 40 and a number of latch recesses 42. The vacuum inlet 40 may be fitted with a vacuum hose 43 for applying suction at desired locations.

The tank 32 supports the upper vacuum assembly 34. The upper vacuum assembly 34 includes a lid 44, a motor housing 46, a cover 48 and a handle 50. The upper vacuum assembly 34 may be of conventional construction. Except as described below, the upper vacuum assembly 34 and its associated components may be similar to a Shop Vac Model QL20TS vacuum cleaner as manufactured by Shop Vac Corporation of Williamsport, Pa. The lid 44 makes up the bottom of the upper vacuum assembly 34 and carries one or more latches 52. The motor housing 46 is connected to the top of the lid 44. The cover 48, in turn, is connected to the top of the motor housing 46, and finally, the handle 50 sits atop the cover 48. When a user wishes to connect the upper vacuum assembly 34 to the tank 32, the user lifts the upper vacuum assembly 34 above the tank 32, aligns the latches 52 with the latch recesses 42, lowers the upper vacuum assembly 34 until the lid 44 rests on top of the tank 32, and then, fastens the latches 52 to the tank 32.

The motor housing 46 defines a pair of blower air discharge slots 54. Air drawn into the vacuum cleaner 30 by the inlet 40 is expelled through the blower air discharge slots 54 as shown by the arrow BA in FIG. 1. The motor housing 46 also has a vacuum cleaner discharge opening 56 and a two position ball valve 58 extending therefrom. The cover 48 of the upper vacuum assembly 34 provides a housing for a switch actuation assembly 60 (FIG. 3) which includes a user engageable actuator 62 (FIG. 2). Extending outward from the cover 48 is an electric cord 64 (FIG. 1) which passes through a relief 65 formed in the cover 48. The motor housing 46 and the cover 48 may be formed as two separate, detachable pieces or as one piece, integral with one another. With either construction, the motor housing 46 and the cover 48 define an air passage 66 which allows air to enter and exit the cover 48, as shown by the arrows CA in FIG. 1.

Referring now to FIG. 3, a lid cage 106 is formed integral with the lid 44 of the upper vacuum assembly 34 and extends downward therefrom into the interior of the tank 32. Disposed within the combination of the lid cage 106 and the upper vacuum assembly 34, among other things, is a motor 93 having a motor shaft 76. The motor shaft 76 is in engageable contact with an air impeller 74 of an air impeller assembly 68, and the end of the motor shaft 76 is disposed in a priming apparatus 350. The priming apparatus 350 has a pump impeller 352 that is disposed within a pump chamber 129, the pump chamber 129 being defined by an upper pump assembly, indicated generally at 120. As described below, the upper pump assembly 120 forms the upper portion of the pump 128 (FIG. 11).

Figure 4:
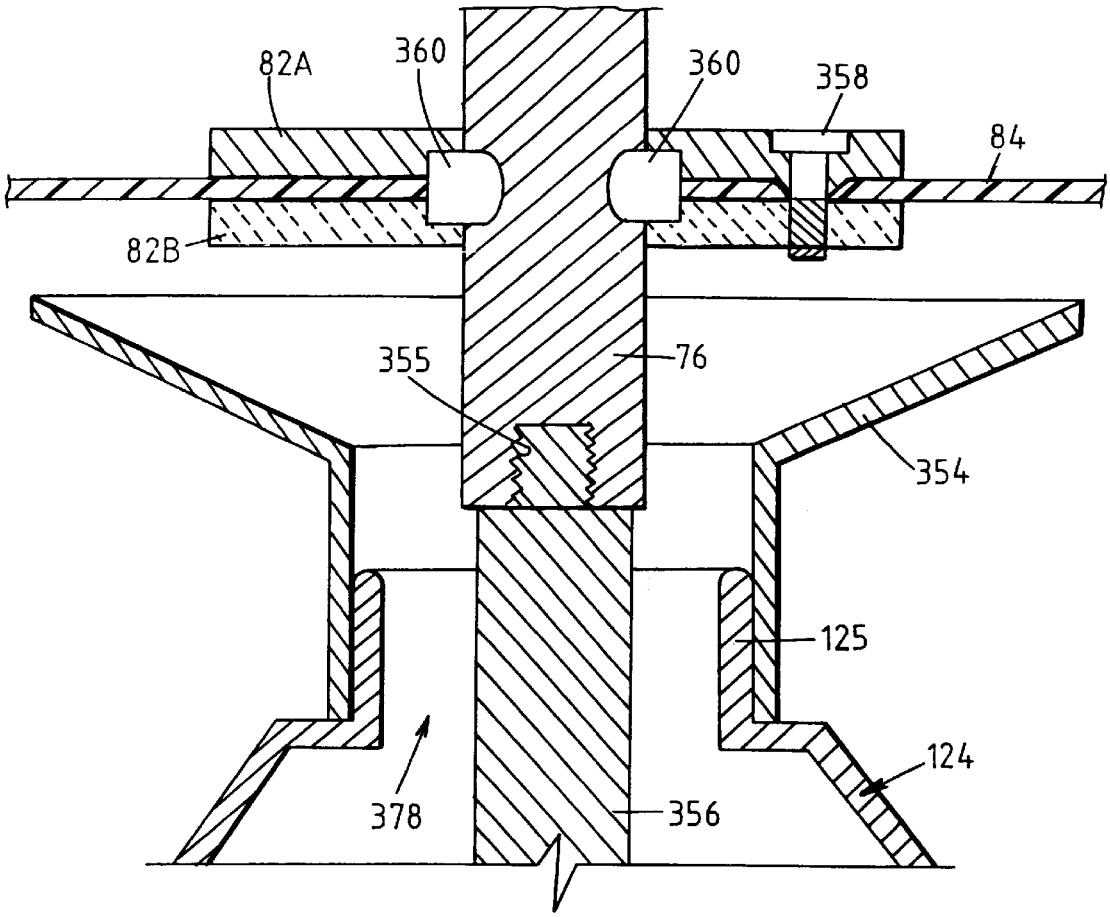
FIG. 4 is a partial view, in section, of an upper portion of priming apparatus.
Figure 11:
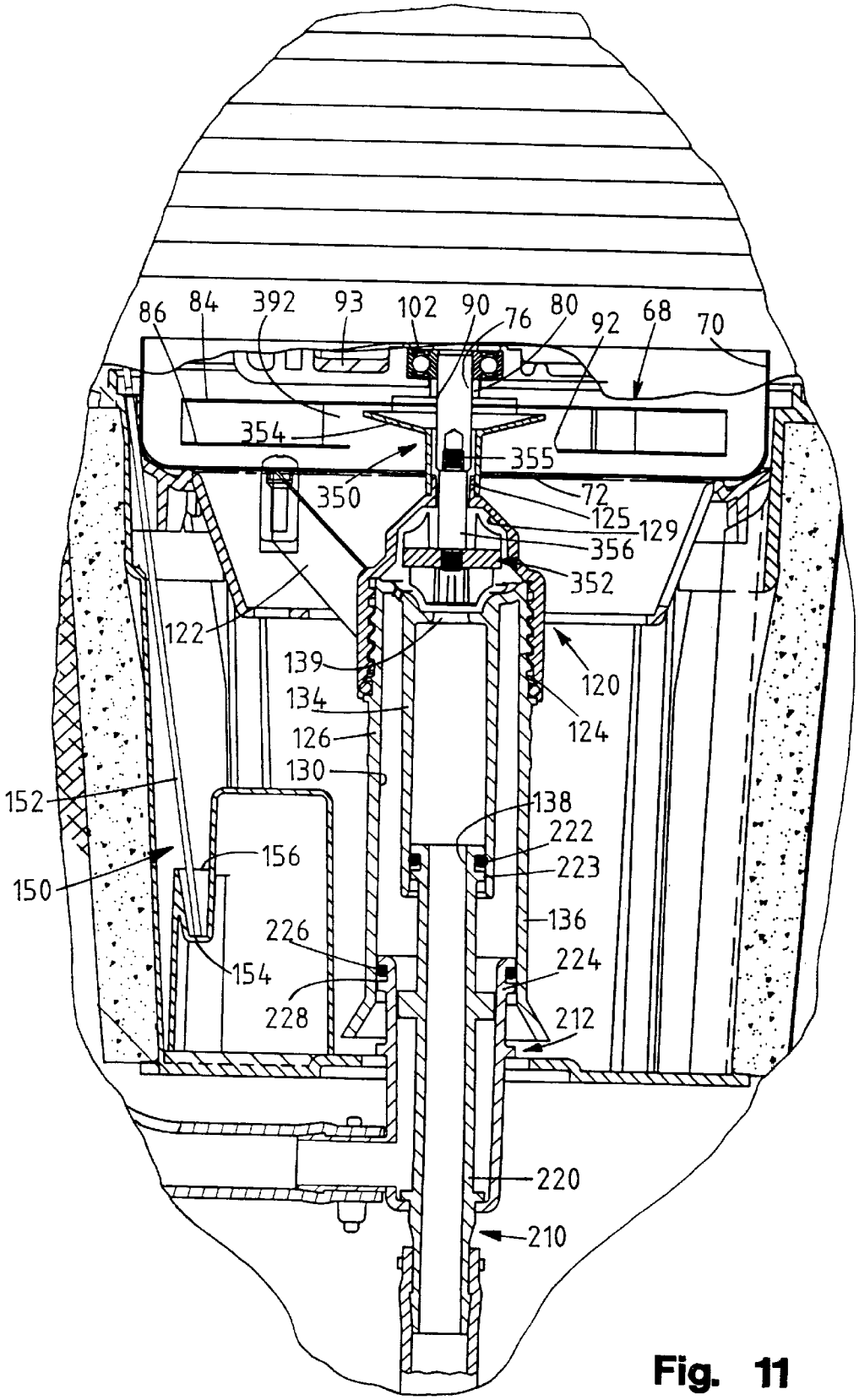
FIG. 11 is an enlarged view of a pump of FIG. 10.

Referring to FIG. 11, the air impeller assembly 68 includes an air impeller housing 70, and the air impeller 74 is suspended within the housing 70 by the interaction of the motor shaft 76 and the priming apparatus 350. (If desired, multiple air impellers may be used in the vacuum cleaner 30.) As best shown in FIGS. 4 and 11, the motor shaft 76 extends from the motor 93, passes through a separation sleeve 80, an upper washer 82A, an opening 90 formed in an upper plate 84 of the air impeller 74, a lower washer 82B and has a socket 355 into which a shaft extension 356 of the priming apparatus 350 is threaded, securing the shaft extension 356 to the motor shaft 76. The separation sleeve 80 and the upper washer 82A are disposed between the upper plate 84 and a motor bearing 102 (FIG. 11), and the lower washer 82B is disposed between the upper plate 84 and the shaft extension 356. The washers 82A, 82B are secured in place by a series of rivets 358 that are pressed into the upper washer 82A, the upper plate 84 and the lower washer 82B. The washers 82A, 82B act to stabilize the air impeller 74 during operation. The upper washer 82A, the upper plate 84 and the lower washer 82B are notched around the opening 90 of the upper plate 84 to receive a pair of swages 360 formed integral with the motor shaft 76 that extend outward therefrom. In operation, the swages 360 engage the upper plate 84 of the air impeller 74 to rotate the air impeller 74 with the motor shaft 76.

Figure 5:
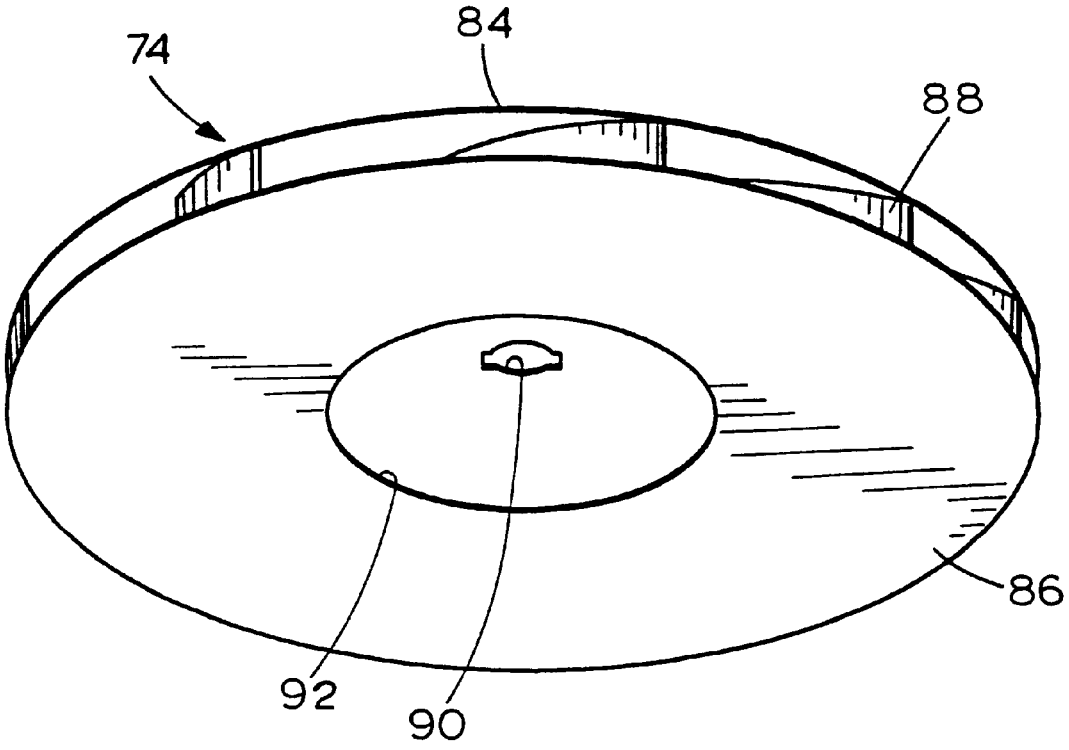
FIG. 5 is a perspective view of an air impeller of the present invention.

The upper pump assembly 120 includes an upper impeller housing 124 having a collar or primary orifice 125 extending therefrom. According to the illustrated embodiment, a vacuum director 354 of the priming apparatus 350 is attached (e.g., press-fit, ultrasonically welded, etc.) to the collar 125 and extends from the collar 125 and the upper plate 84 of the air impeller 74. In the alternative, the vacuum director 354 is formed integrally with the collar 125 and upper impeller housing 124. The vacuum director 354 defines an air flow path between an interior space 392 defined by the air impeller 74 (FIG. 11) and a gap 378 (FIG. 4) defined between the shaft extension 356 and an interior of the collar 125. The vacuum director 354 has an inlet neck portion and an outwardly flaring outlet portion. As illustrated in FIG. 4, the vacuum director 354 is positioned so that a top edge is spaced from the upper plate 84 of the air impeller 74 to allow fluid communication between the air impeller interior space 392 and the interior of the vacuum director 354. The interior of the vacuum director 354 also fluidly communicates with the pump chamber 129 through the gap 378, so that a continuous, uninterrupted flow path is formed from the air impeller interior space 392 to the pump chamber 129. Since the vacuum director is attached to the stationary upper impeller housing 124, it does not rotate with the motor shaft 76. As illustrated in FIG. 5, the air impeller 74 also includes a series of blades 88 disposed between the upper plate 84 and a lower plate 86.

Referring to FIG. 11, the shaft extension 356, is threadedly attached to the motor shaft 76, extends from the flat washer 82B through an opening 92 formed in the lower plate 86 of the air impeller 74, through an opening 72 formed in the air impeller housing 70, and, eventually, threads into the pump impeller 352 disposed in the pump chamber 129 of the upper pump assembly 120.

Figure 6A:
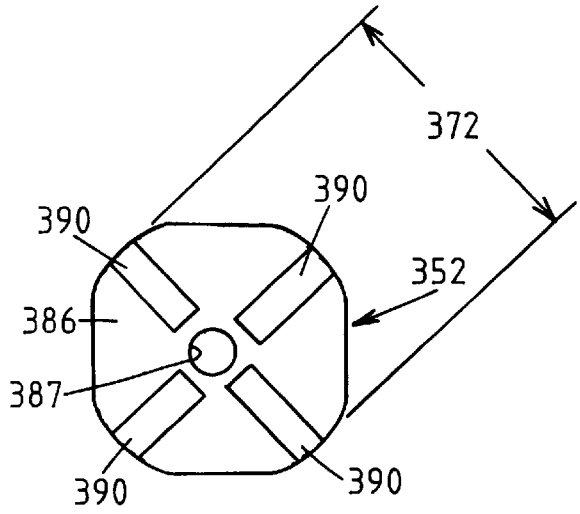
FIG. 6A is a top view of a pump impeller of the present invention.
Figure 6B:
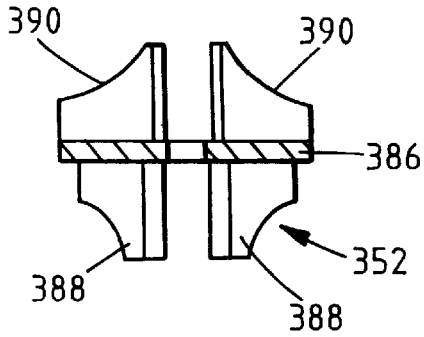
FIG. 6B is a side sectional view of the pump impeller.
Figure 6C:
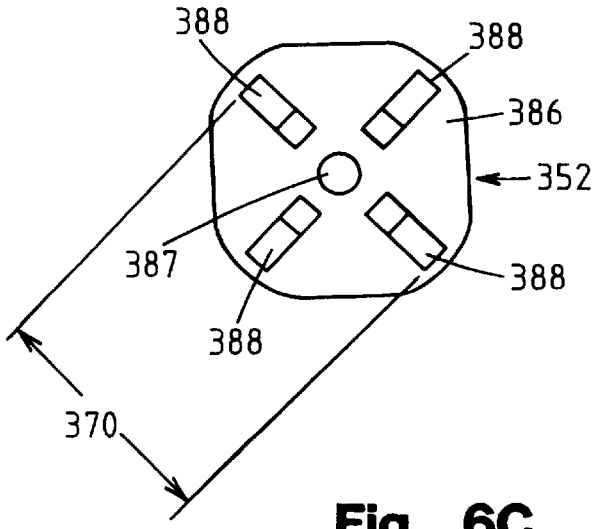
FIG. 6C is a bottom view of the pump impeller.

Referring to FIGS. 6A–6C, the pump impeller 352 is shown in greater detail. The pump impeller 352, which is preferably made of nylon 6, includes a base plate 386 having a threaded aperture 387 which is fastened to an end of the shaft extension 356, securing the pump impeller 352 inside the pump chamber 129. Formed integral with the base plate 386 and extending downward therefrom are a first set of four impeller blades 388. Formed integral with the base plate 386 and extending upward therefrom are a second set of four impeller blades 390. The exact number and configuration of the first and second sets of impeller blades 388, 390 is not critical. In the preferred embodiment, however, each blade 388, 390 is aligned axially with respect to the shaft extension 356. As a result, outside edges of the first set of impeller blades form an outside diameter 370, while outside edges of the second set of impeller blades also form an outside diameter 372. In a most preferred embodiment, the outside diameter 372 of the second set is greater than the outside diameter 370 of the first set, as explained in greater detail below. The first and second sets of impeller blades 388, 390 rotate simultaneously with the shaft extension 356.

Referring again to FIG. 3, the lid cage 106 includes several braces 108 that support a bottom plate 110. The bottom plate 110 defines an oblong opening 112. A removable foam, filter 116 surrounds the circumference of the lid cage 106 and, as depicted in FIG. 3, a cloth filter 118 may be placed around the lid cage 106 during dry use of the vacuum cleaner 30 to keep dust from entering the opening 112 and interfering with the lid cage assemblies. A mounting ring 119 holds the foam and cloth filters 116, 118 in place. The mounting ring 119 is put in place by sliding the ring 119 over the foam and cloth filters 116, 118 and sliding the ring 119 up to the bottom of the lid 44. Instead of using a separate foam and cloth filter 116,118, as described above, a unitary cartridge filter may be used which allows for easier replaceability.

In the illustrated embodiment, the upper pump assembly 120 has a pump mount portion 122 which connects the upper pump assembly 120 to the air impeller housing 70. As detailed in FIG. 11, the upper pump assembly 120 includes the upper impeller housing 124 which is formed integrally with the pump mount 122; a lower impeller housing 126 which, in this embodiment, is threaded into the upper impeller housing 124; and the pump impeller 352 which, as described above, is connected to the shaft extension 356. The interior of the upper impeller housing 124 and the top of the lower impeller housing 126 form the pump chamber 129. The shaft extension 356 keeps the pump impeller 352 suspended in the pump chamber 129 between the upper and lower impeller housings 124, 126 allowing the pump impeller 352 to rotate freely therein. The upper and lower impeller housings 124, 126 are preferably made from acrylonitrile-butadiene styrene copolymer ("ABS").

Referring now to FIG. 11, the lower impeller housing 126 defines an upper outlet sidewall 136 and an inlet sidewall 134. The upper outlet sidewall 136 is the outermost and longer sidewall of the lower impeller housing 126, and when the pump 128 is assembled, the upper outlet sidewall 136 forms part of a pump outlet 130. The bottom portion of the upper outlet sidewall 136 is flared outward to ease assembly of the pump 128. The inlet sidewall 134 is disposed radially inward of the upper outlet sidewall 136 and has a shorter length. The inlet sidewall 134 forms part of a pump inlet 138 when the pump 128 is assembled. An opening 139 is formed radially inward of the inlet sidewall 134 which allows fluid communication between the pump inlet 138 and the pump chamber 129 when the pump 128 is assembled.

Referring again to FIG. 3, the lid cage 106 also encloses an air impeller protection cage 146. The air impeller protection cage 146 extends downward from the bottom of the air impeller housing 70 and is disposed around the pump mount portion 122. The protection cage 146 acts to keep large debris out of the air impeller assembly 68 to prevent such debris from interfering with the operation of the air impeller 74. The protection cage 146 is formed of ribbed slats which allow the protection cage 146 to keep large debris out of the air impeller assembly 68 while allowing air to flow between the air impeller assembly 68 and the tank 32.

The upper vacuum assembly 34 also houses a mechanical shut-off and override assembly indicated generally at 150. The mechanical shut-off and override assembly 150 includes the aforementioned switch actuation assembly 60, a switch 151, a float rod 152 and a float 154. The mechanical shut-off and override assembly 150 may be of any conventional design or may be of the type disclosed and claimed in U.S. patent application Ser. No. 08/727,318, now U.S. Pat. No. 5,918,344. In this embodiment, the switch actuation assembly 60 and the switch 151 are located in the cover 48, and the float 154 rests on the bottom plate 110 of the lid cage 106. The switch 151 controls the power to the motor 93 and has an "ON" and "OFF" position. The switch 151 is linked to the user engageable actuator 62 and to the float 154. The float 154 is hollow and may be made of any suitable material, such as copolymer polypropylene. The float 154 defines a rod receptacle 156 in which the float rod 152 sits. The float rod 152 extends upward from the float 154 and passes through the lid 44 and the motor housing 46, providing the linkage between the switch 151 and the float 154.

Figure 9B:
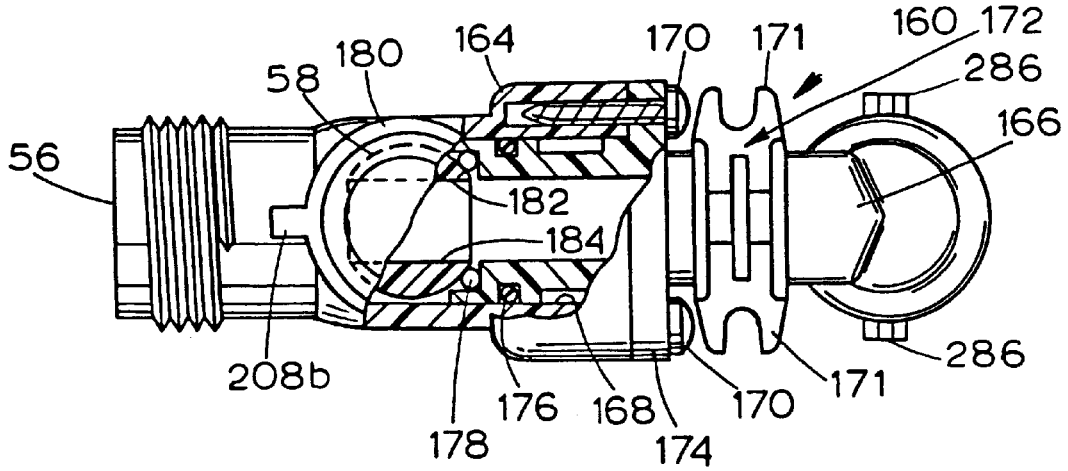
FIG. 9B is a top view similar to FIG. 9A showing the ball valve in an open (ON) position.
Figure 10:
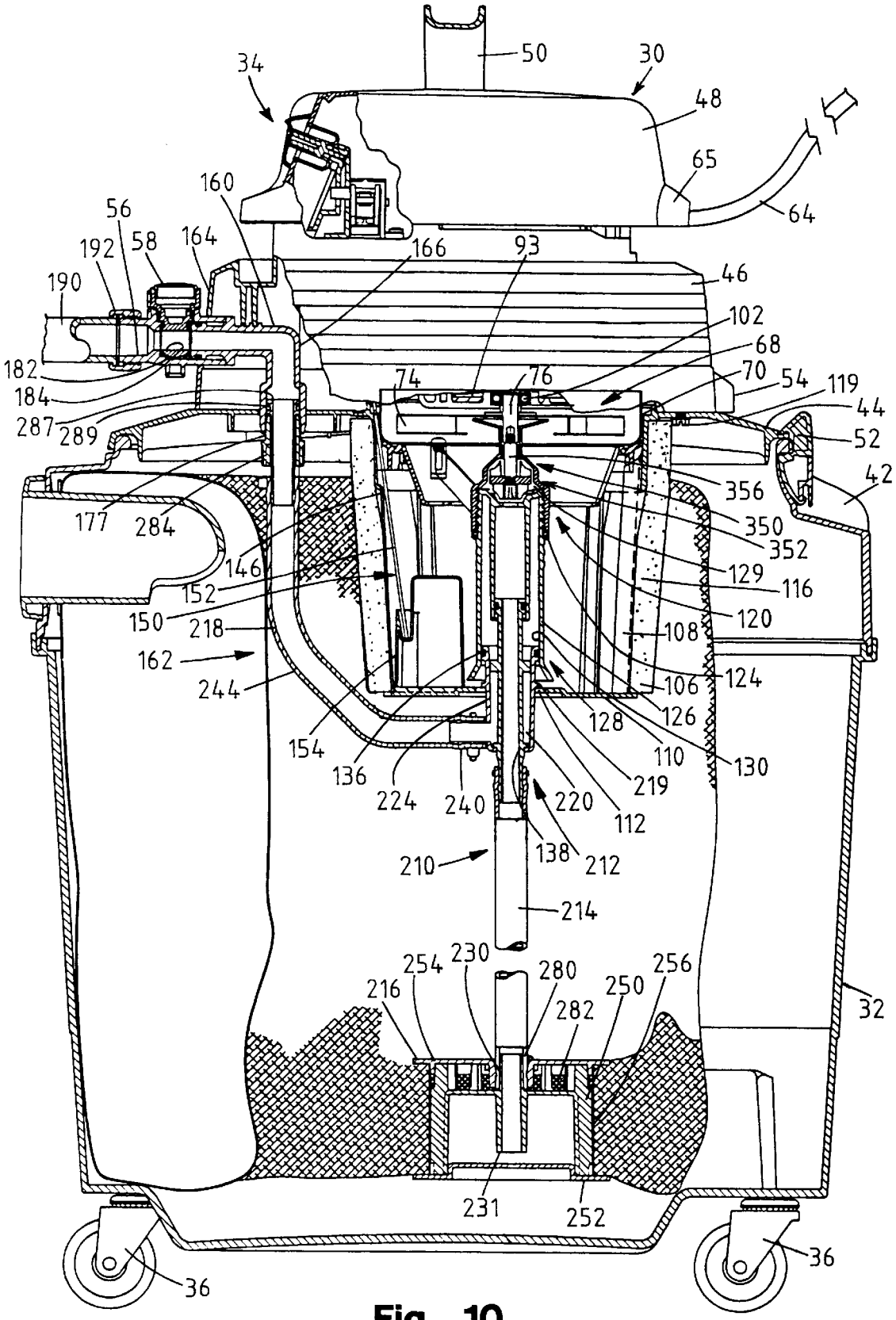
FIG. 10 is a view similar to FIG. 3 with a pump adapter assembly installed and a discharge hose attached to the vacuum cleaner of the present invention.

Also housed in the upper vacuum assembly 34 is an upper portion 160 of a liquid discharge assembly 162 (FIG. 10). Referring to FIGS. 7–9B, three main components form the structure of the upper portion 160 of the liquid discharge assembly 162: a valve housing 164, the two position ball valve 58 and a discharge elbow 166. As seen in FIG. 7, the elbow 166 seats in an elbow cavity 168 formed in the housing 164, and the elbow 166 is connected to the housing 164 by any means practical—a pair of screws 170 (FIG. 8) in this embodiment. A pair of connection tabs 171 (FIG. 8) and a series of positioning ribs 172 are formed integral with the elbow 166. When the vacuum cleaner 30 is assembled, the connection tabs 171 are used to connect the upper portion 160 of the liquid discharge assembly 162 to the motor housing 46, and the positioning ribs 172 are used to align the elbow 166 in the motor housing 46. The elbow 166 also has a pair of J-shaped grooves 173 formed therein for connecting a lower portion 218 of the liquid discharge assembly 162 to the upper portion 160 (FIG. 10). A plug 175 may be placed in the elbow 166 during dry vacuuming to plug an opening 177 in the elbow 166 (FIG. 3). The plug 175 interacts with the J-shaped grooves 173 in the elbow 166 to keep the plug 175 in place.

The elbow 166 forms a liquid-tight seal with the housing 164 by means of series of seals and closures. In this embodiment, O-rings are used as seals, but it is envisioned that any form of seal known in the art would suffice. A housing closure 174, formed integral with the elbow 166, caps off the housing 164 at the point where the housing 164 meets the elbow 166. Internal to the housing 164, a seal 176 disposed around the elbow 166 creates a liquid-tight seal between the housing 164 and the elbow 166, and a seal 178 disposed between the elbow 166 and the ball valve 58 prevents liquid from leaking between the two.

The ball valve 58 has a positional knob 180 formed integral with a flow regulation ball 182. The ball 182 has a passageway 184 bored therethrough, and the ball 182 is capable of being turned such that the passageway 184 is placed in fluid communication with the interior of the elbow 166. The positional knob 180 is situated outside the housing 164. As discussed above, a seal 178 keeps liquid from leaking between the ball 182 and the elbow 166. A similar seal 186 disposed on the opposite side of the ball 182 keeps liquid from leaking between the ball 182 and the housing 164. Another seal 188, disposed between the ball 182 and the knob 180, prevents liquid from leaking past the knob 180. The vacuum cleaner discharge opening 56 is defined by the housing 164 and is encircled by a threaded portion so that a user may connect a discharge hose 190 (FIG. 10) having a threaded connector 192 (e.g. a garden hose) to the housing 164 when discharging liquid, if desired.

Referring specifically to FIGS. 7, 8 and 9A–B, the ball valve 58 has two operational positions to control the flow rate of the liquid being discharged. FIG. 9A shows the ball valve 58 in the closed (OFF) position, when the pump is not discharging any liquid; and FIG. 9B shows the ball valve 58 in the open (ON) position, where the pump is discharging liquid from the vacuum cleaner 30. The knob 180 indicates which position the ball valve 58 is in by the location of one of two dogs 208*a–b* formed integrally with the knob 180. When the dog 208*a* is pointed towards the vacuum cleaner discharge opening 56, as in FIG. 9A, the ball valve 58 is in the closed (OFF) position. In the closed (OFF) position, the flowpath between the interior of the elbow 166 and the vacuum cleaner discharge opening 56 is interrupted by the flow regulation ball 182. In this position, the flow regulation ball 182 is turned such that the passageway 184 runs perpendicular to, and out of fluid communication with, the interior of the elbow 166 and the vacuum cleaner discharge opening 56. The user can also turn the knob 180 so that the dog 208*b* is pointed towards the vacuum cleaner discharge opening 56, as in FIG. 9B. The ball valve 58 is then in the open (ON) position with the passageway 184 aligned with the interior of the elbow 166 and the vacuum cleaner discharge opening 56 creating a complete flow path from the interior of the elbow 166 to the vacuum cleaner discharge opening 56, which allows liquid to be discharged from the vacuum cleaner 30.

FIGS. 10–11 illustrate the vacuum cleaner 30 with a pump adapter assembly 210 installed. Referring to FIG. 10, the pump adapter assembly 210 includes a lower pump assembly 212, an inlet tube 214, a liquid intake assembly 216 and the lower portion 218 of the liquid discharge assembly 162. Referring to FIG. 11, the lower pump assembly 212, which is preferably made from ABS, extends up into the upper pump assembly 120 to complete the pump 128. The outward flare of the bottom portion of the upper outlet sidewall 136 facilitates insertion of the lower pump assembly 212 into the upper pump assembly 120. The pump adapter assembly 210 is secured in place by an oblong flange 219 (FIG. 10), which is formed integrally with a lower outlet sidewall 224 of the pump adapter assembly 210. When the pump adapter assembly 210 is in this secured disposition, the oblong flange 219 is disposed within the lid cage 106 across the oblong opening 112 of the bottom plate 110 such that the major axis of the oblong flange 219 lies substantially perpendicular to the major axis of the oblong opening 112. In this installed configuration, a pump inlet tube 220 of the lower pump assembly 212 extends up into the inlet sidewall 134 to complete the formation of the pump inlet 138, and the lower outlet sidewall 224 of the lower pump assembly 212 extends up into the upper outlet sidewall 136 to complete the formation of the pump outlet 130. The pump inlet tube 220 and the inlet sidewall 134 interact to form a liquid seal between the two. The liquid seal is formed by the interaction of a seal 222 with the inlet sidewall 134. The seal 222 is disposed in a groove 223 formed in the pump inlet tube 220. In a similar manner, the upper and lower outlet sidewalls 136, 224 also interact with each other to form a liquid seal.

A seal 226 seated in a groove 228 formed in the lower outlet sidewall 224 interacts with the upper outlet sidewall 136 to form this liquid seal.

Referring again to FIG. 10, the pump inlet tube 220 fits into the inlet tube 214. The other end of the inlet tube 214 connects to a fitting 230 formed on the liquid intake assembly 216. The liquid intake assembly 216 has a hollow body 250 closed on the bottom by a plate 252. A cover plate 254 is connected to the top of the hollow body 250, and a screen 256 is disposed around the hollow body 250 between the bottom plate 252 and the cover plate 254. The fitting 230 is formed in the top of the hollow body 250. The fitting 230 extends upward through an opening 280 formed in the cover plate 254 and, as discussed above, connects with the inlet tube 214. The fitting 230 also extends downward into the hollow body 250, terminating at an inlet portion 231. Also formed in the top of the hollow body 250 is a liquid inlet opening 282 which provides fluid communication between the interior of the hollow body 250 and the tank 32.

On the outlet side of the pump 128, a fitting 240, formed integral with the lower outlet sidewall 224 of the pump 128, connects a discharge tube 244 of the liquid discharge assembly 162 to the lower outlet sidewall 224. This connection places the pump outlet 130 in fluid communication with the liquid discharge assembly 162. The discharge tube 244 extends from the lower outlet sidewall 224 to the elbow 166 of the upper portion 160 of the liquid discharge assembly 162 where a rotatable connector 284, attached to the end of the discharge tube 244, connects the discharge tube 244 to the elbow 166. The rotatable connector 284 is a free spinning element and is not fixed to the discharge tube 244. The rotatable connector 284 has a pair of bosses 286 integrally formed therewith (FIG. 8). To connect the discharge tube 244 to the elbow 166 of the upper portion 160, the user manipulates the rotatable connector 284 to line up the bosses 286 with the pair of J-shaped grooves 173 formed in the elbow 166 (FIG. 10). The user then inserts the rotatable connector 284 into the elbow 166, pushing the bosses 286 along the grooves 173 and twisting the rotatable connector 284 as necessary. When the bosses 286 reach the end of the grooves 173, the lower portion 218 of the liquid discharge assembly 162 is locked in place, and the liquid discharge assembly 162 is complete. A seal 287, disposed in a groove 289 at the end of the discharge tube 244, prevents liquid from leaking out of the elbow 166 into the tank 32 (FIG. 10).

The vacuum cleaner 30 may be operated in three modes: dry vacuuming mode, wet vacuuming mode and pumping mode. FIG. 3 shows the vacuum cleaner 30 in dry vacuuming mode configuration. In dry vacuuming mode configuration, the ball valve 58 is in the closed (OFF) position, the plug 175 is in the elbow opening 177, and the cloth filter 118 is in place around the lid cage 106 to keep dust from entering the opening 112. To convert the vacuum cleaner 30 to wet vacuuming mode configuration (without pumping liquid from the tank 32), the cloth filter 118 is removed, the ball valve 58 remains in the closed (OFF) position, and the plug 175 remains in the elbow opening 177. To operate the vacuum cleaner 30 in either dry or wet vacuuming mode, the user engages the actuator 62 and turns the motor 93 on. The operating motor 93 turns the air impeller 74, via the motor shaft 76, in the air impeller housing 70 which creates a vacuum in the tank 32. The user is now able to vacuum materials into the tank 32. When the user is finished vacuuming or the tank 32 is full, the user can stop vacuuming by engaging the actuator 62 to turn the motor 93 off. If, while in wet vacuuming mode, the level of liquid in the tank 32 gets too high, the mechanical shut-off and override assembly 150 will automatically shut off the motor 93.

To convert the vacuum cleaner 30 to pumping mode, the pump adapter assembly 210 is installed (FIGS. 10–11). To install the pump adapter assembly 210 and complete the pump 128, the user inserts the lower pump assembly 212 of the pump adapter assembly 210 through the opening 112 in the lid cage bottom plate 110, aligns the oblong flange 219 with the oblong opening 112 and pushes the oblong flange 219 through the oblong opening 112 so that the oblong flange 219 is now within the lid cage 106. The user inserts the lower pump assembly 212 into the lower impeller housing 126 of the upper pump assembly 120 and, once in, twists the pump adapter assembly 210 so that the major axis of the oblong flange 219 lies substantially perpendicular to the major axis of the oblong opening 112 to secure the pump adapter assembly 210 in place. As explained above, the outward flare of the bottom portion of the upper outlet sidewall 136 facilitates insertion of the pump adapter assembly 210 into the lower impeller housing 126. During insertion, the pump inlet tube 220 slides within the upper inlet sidewall 134 of the lower impeller housing 126, and the seal 222 forms a seal with the upper inlet sidewall 134. Similarly, the lower outlet sidewall 224 of the lower pump assembly 212 slides within the upper outlet sidewall 136 of the lower impeller housing 126, and the seal 226 forms a seal with the upper outlet sidewall 136. The completed pump 128 includes the pump inlet 138, formed by the interaction of the pump inlet tube 220 and the inlet sidewall 134; the pump impeller 352 disposed in the pump chamber 129; and the pump outlet 130, formed by upper and lower outlet sidewalls 136, 224. The dimension of each of the parts of the pump 128 will be dependent on the desired flow rate of the pump 128. In addition, the power of the motor 93 may also affect the size and design of many of the components, including the pump impeller 352. To finish installation of the pump adapter assembly 210 and complete the formation of the liquid discharge assembly 162, the user connects the discharge tube 244 to the upper portion 160 of the liquid discharge assembly 162. As explained above, to connect the discharge tube 244 to the upper portion 160 of the liquid discharge assembly 162, the user rotates the rotatable connector 284 of the discharge tube 244 to align the bosses 286 of the rotatable connector 284 with the J-shaped grooves 173 of the elbow 166. Once the bosses 286 are aligned, the user pushes the bosses 286 along the grooves 173 until the bosses 286 reach the end of the groove 173 (FIG. 8). Once the bosses 286 are at the end of the grooves 173, the rotatable connector 284 and the lower portion 218 of the liquid discharge assembly 162 are locked in place, and the installation of the pump adapter assembly 210 and the formation of the liquid discharge assembly 162 are complete.

If the user desires to filter large particulates out of the material being drawn into the vacuum cleaner 30, the user may install a mesh collection bag in the tank 32 and connect the bag to the inlet 40. The mesh collection bag may be of the type disclosed and claimed in U.S. patent application Ser. No. 08/903,635, now U.S. Pat. No. 6,079,076. Once the pump adapter assembly 210 is installed, and if desired, any collection bags, the user inserts the combined upper vacuum assembly 34/pump adapter assembly 210 into the tank 32 and then secures the lid 44 to the tank 32 with the latches 52.

Referring to FIG. 10, to operate the vacuum cleaner 30 in combined wet vacuuming mode and pumping mode operation, the user first turns the motor 93 "ON" by engaging the actuator 62. The now energized motor 93 simultaneously turns the air impeller 74 and the pump impeller 352 via the motor shaft 76/shaft extension 356 combination. The air impeller 74, rotating in the housing 70, reduces the pressure in the tank 32, creating a vacuum. The rotating air impeller 74 also creates a low pressure area in the interior space 392 of the air impeller 74 such that the interior space 392 of the air impeller 74 is at a relatively lower pressure than the vacuum in the tank 32. The vacuum created in the tank 32 draws air, liquid and/or other material into the tank 32 through the vacuum hose 43 and the inlet 40. If a mesh collection bag is in place around the inlet 40, the mesh collection bag will filter out the exceptionally large particulates being vacuumed into the tank 32 and will reduce the possibility of the pump 128 getting clogged. Even if the pump 128 is not being used, the mesh collection bag could still be used to filter large particulates out from the liquid being collected in the tank 32 so that when the tank 32 is poured or emptied into a drain, the large particulates will not clog the drain. The air that is drawn into the tank 32 passes through the foam filter 116, through the lid cage 106, into the motor housing 46, and finally is expelled out of the discharge slots 54.

As the motor 93 continues to operate, liquid will continue to collect in the tank 32. As liquid collects in the tank 32 and the liquid level rises, liquid will enter into the liquid intake assembly 216. The liquid will flow through the screen 256 and into the hollow body 250 through the opening 282. Liquid will then collect in the hollow body 250. When the liquid level in the hollow body 250 reaches the inlet portion 231 of the fitting 230, the pump 128 is capable of self-priming. Priming is possible because the low pressure area created by the air impeller 74 in the interior space 392 of the air impeller 74 creates a low pressure area in the pump chamber 129 as well, due to the air flow path between the interior space 392 of the air impeller 74 and the pump chamber 129 described above. The pump will prime when the low pressure in the pump chamber 129 is sufficient to draw the liquid collecting at the inlet portion 231 of the fitting 230 up through the fitting 230, through the inlet tube 214, through the pump inlet 138 and into the pump chamber 129, thereby priming the pump 128. The low pressure in the pump chamber 129 will generally be lower than the pressure of the vacuum in the tank 32 as long as there is flow through the tank inlet 40. Liquid flowing up into the pump chamber 129, however, will not pass through the gap 378 between the shaft extension 256 and collar 125, and consequently will not enter the area of the air impeller 74 or the motor 93, due to a pressure created by rotation of the second set of impeller blades 390. As noted above, the outer diameter 372 of the second set of impeller blades 290 is preferably larger than the outer diameter 370 of the first set of impeller blades 288 to ensure that the pressure force produced by the second set is greater than that of the first set, thereby preventing fluid from leaking through the gap 378. In most situations, the knob 180 must be in the closed (OFF) position to effect priming of the pump 128. Otherwise air from atmosphere will be pulled into the pump chamber 129 from the discharge opening 56, thereby preventing the formation of a low pressure area in the pump chamber 129.

While, for clarity of illustration, the pump 128 has been shown with a particular type of priming apparatus 350, it will be appreciated that the teachings of the present invention are in no way limited to use with that particular priming apparatus. On the contrary, the pump 128 of the present invention may be used with any type of priming apparatus which adequately primes the pump chamber 129, including but not limited to apparatus which fills the pump chamber 129 through the pump inlet or outlet. When the pump 128 is used in other applications in which a separate air impeller is not provided, the priming apparatus may include a motor cooling fan to draw fluid into the pump chamber 129. With that being said, the pump 128 of the present invention is particularly suited for use in a vacuum cleaner having the priming apparatus 350 illustrated herein, since the gap 378 may be used to establish fluid communication between the interior portion of the air impeller 392 and the pump chamber 129. Because of the second set of impeller blades 290, the size of the gap 378 may be increased without having fluid leak through the gap 378.

From the pump chamber 129, the pumped liquid will be pumped into the pump outlet 130 and into the liquid discharge assembly 162. If the knob 180 is in the closed (OFF) position, the liquid will back up behind the flow regulation ball 182 and will not discharge from the vacuum cleaner 30 through the discharge opening 56. Once the user, however, is ready to discharge liquid from the vacuum cleaner 30, the user may turn the knob 180 to the open (ON) position, allowing the vacuum cleaner 30 to discharge the pumped liquid through the discharge opening 56 and into the hose 190. Once the pump 128 is primed, it is not likely to lose its prime due to deterioration of the seal 222. When the pump 128 is pumping liquid out, the seal 222 is surrounded by liquid because both the area enclosed by the inlet sidewall 134 and the pump outlet 130 are filled with liquid. As such, even if the seal 222 begins to deteriorate, air will not enter the pumping chamber 129 and cause the pump 128 to lose its prime. The pump 128 will, however, operate less efficiently in this situation.

If, while vacuuming, the level of the liquid in the tank 32 gets too high, the mechanical shut-off and override assembly 150 will automatically shut-off the motor 93. When the liquid in the tank 32 gets to the level of the float 154, the liquid pushes the float 154 upward which pushes the float rod 152 upward. Eventually, the rising liquid will push the float rod 152 high enough to turn the switch 151 "OFF" which stops the motor 93 and stops the air impeller 74 and the pump impeller 352 from rotating. The float 154 should be placed at a height low enough so that the motor 93 is turned "OFF" before the level of liquid is high enough to begin entering the air impeller 74. Once the motor 93 has been turned "OFF", the user, when in pumping mode, has two options: the user may either remove the upper vacuum assembly 34 and manually empty the tank 32 or the user may bypass the float shut-off by mechanically overriding the float shut-off. When the user is finished either vacuuming or pumping with the vacuum cleaner 30, the user turns the vacuum cleaner 30 "OFF" by pushing downward on the user engageable actuator 62.

The pump of the present invention has significant advantages over prior pumps. By providing an impeller assembly having a second set of impeller blades, the pump prevents fluid from leading through a gap between the shaft and a shaft opening without requiring a mechanical seal. As a result, there is no seal which wears or causes wear on the shaft extension as the shaft extension rotates, nor is frictional heat generated by the engagement of such a seal with the shaft extension. The pump is also tolerant of eccentricities or wobble as the shaft rotates. Furthermore, the pump may run dry without danger of quickly destroying a mechanical seal.

According to the illustrated embodiment, the pump is advantageously incorporated into a vacuum cleaner capable of collecting both dry material and fluid. The pump allows an air impeller to be mounted closer to the pump, since there is no danger of fluid leaking into the air impeller or motor. This allows the shaft extension to be shorter, which reduces wear and noise. In addition, the number of components attached to the rotating motor shaft is reduced from previously known vacuum cleaners, thereby further reducing wear on the motor shaft and shaft extension.

The foregoing detailed description has been given for clearness of understanding only, and no unnecessary limitations should be understood therefrom, as modifications would be obvious to those skilled in the art.

We claim:

1. A vacuum cleaner comprising:

a tank having an inlet for receiving liquid material, the tank defining an interior;

an air impeller housing having an opening in air flow communication with the tank interior;

a driven air impeller disposed inside the air impeller housing and defining an interior impeller space, the air impeller creating a low pressure area in the tank interior and a lower pressure area at the interior impeller space;

a pump housing having an inlet in fluid communication with the tank interior, an outlet in fluid communication with an exterior of the tank, and a priming orifice;

a powered pump impeller disposed inside the pump housing;

a shaft mechanically connecting the pump impeller and the air impeller; and a vacuum director extending between the pump housing priming orifice and the interior impeller space to define a priming air flow path between the shaft and the vacuum director.

2. The vacuum cleaner of claim 1, in which the vacuum director has an inlet neck portion attached to the pump housing priming orifice and an outwardly flaring outlet portion disposed inside the interior impeller space.

3. The vacuum cleaner of claim 2, in which the air impeller comprises a lower plate having an opening sized for receiving the vacuum director outlet portion.

4. The vacuum cleaner of claim 1, in which the pump impeller comprises a first set of impeller blades for drawing liquid from the tank and a second set of impeller blades for preventing liquid from flowing through the priming orifice.

5. The vacuum cleaner of claim 1, further comprising a pump inlet assembly removably attached to the pump housing inlet.

* * * * *